US007621338B2

(12) United States Patent
Wenham et al.

(10) Patent No.: US 7,621,338 B2
(45) Date of Patent: Nov. 24, 2009

(54) NON-ORIENTING TREE CAP

(75) Inventors: Michael A. Wenham, Kintor (GB); Alistair D. Crozier, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 95 days.

(21) Appl. No.: 11/829,706

(22) Filed: Jul. 27, 2007

(65) Prior Publication Data

US 2009/0025939 A1 Jan. 29, 2009

(51) Int. Cl.
*E21B 29/12* (2006.01)

(52) U.S. Cl. ..... 166/343; 166/75.13; 166/97.1; 166/356; 166/368

(58) Field of Classification Search ..... None
See application file for complete search history.

(56) References Cited

U.S. PATENT DOCUMENTS

| | | | | |
|---|---|---|---|---|
| 4,405,016 | A * | 9/1983 | Best | 166/337 |
| 5,868,204 | A * | 2/1999 | Pritchett et al. | 166/368 |
| 5,992,526 | A * | 11/1999 | Cunningham et al. | 166/343 |
| 6,003,602 | A * | 12/1999 | Wilkins | 166/339 |
| 6,050,339 | A * | 4/2000 | Milberger | 166/368 |
| 6,302,212 | B1 * | 10/2001 | Nobileau | 166/368 |
| 6,474,416 | B2 * | 11/2002 | Beall et al. | 166/343 |
| 6,637,514 | B1 * | 10/2003 | Donald et al. | 166/368 |
| 6,763,891 | B2 * | 7/2004 | Humphrey et al. | 166/368 |
| 6,776,230 | B2 * | 8/2004 | Collie et al. | 166/97.1 |
| 6,817,417 | B2 * | 11/2004 | Blair et al. | 166/335 |
| 6,966,383 | B2 * | 11/2005 | Milberger et al. | 166/368 |
| 7,325,598 | B2 * | 2/2008 | Bartlett | 166/75.13 |
| 2002/0000315 | A1 | 1/2002 | Kent et al. | |
| 2002/0088622 | A1 * | 7/2002 | Beall et al. | 166/342 |
| 2003/0111228 | A1 * | 6/2003 | Garrett et al. | 166/348 |
| 2004/0074636 | A1 | 4/2004 | Bartlett et al. | |
| 2004/0216885 | A1 * | 11/2004 | Bartlett | 166/343 |
| 2004/0262010 | A1 * | 12/2004 | Milberger | 166/368 |
| 2005/0028984 | A1 * | 2/2005 | Donald et al. | 166/368 |
| 2008/0087436 | A1 * | 4/2008 | Baskett | 166/344 |
| 2008/0190621 | A1 * | 8/2008 | Huang et al. | 166/339 |

FOREIGN PATENT DOCUMENTS

| | | | |
|---|---|---|---|
| GB | 2401887 | A | 11/2004 |
| WO | WO9928593 | | 6/1999 |
| WO | WO2004041455 | A3 | 5/2004 |

* cited by examiner

*Primary Examiner*—Thomas A Beach
(74) *Attorney, Agent, or Firm*—Bracewell & Giuliani

(57) ABSTRACT

A wellhead assembly includes a tree cap having a production mandrel extending down into a production passage of a Christmas tree to form a seal. The tree has an annulus bore and an annular cavity at the upper end of the tree surrounding the upper ends of the production and annulus bore. A communication gallery leads between the annulus bore and the cavity. The tree cap also includes an annular sealing member that enters the cavity for sealing a communication gallery.

10 Claims, 3 Drawing Sheets

Fig. 1
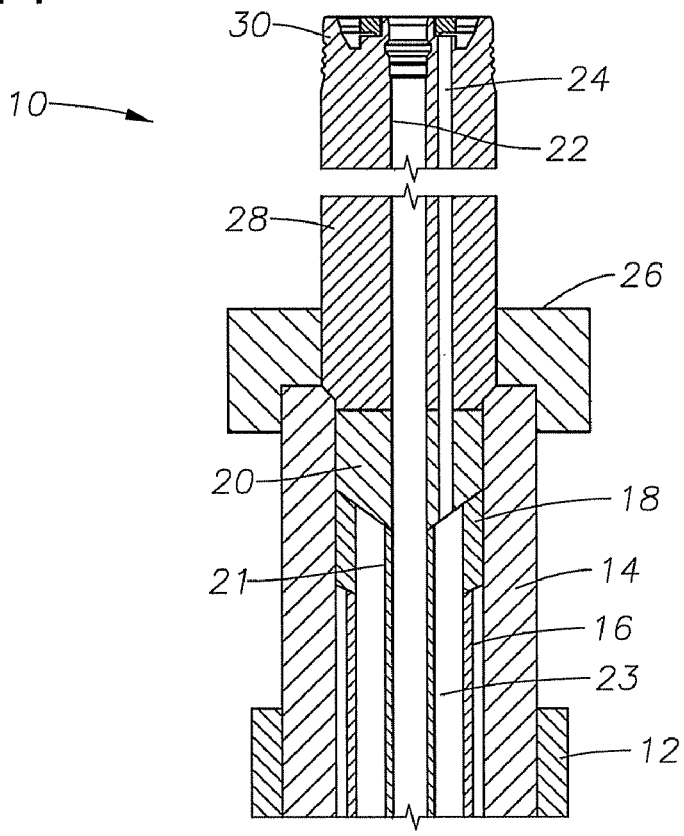
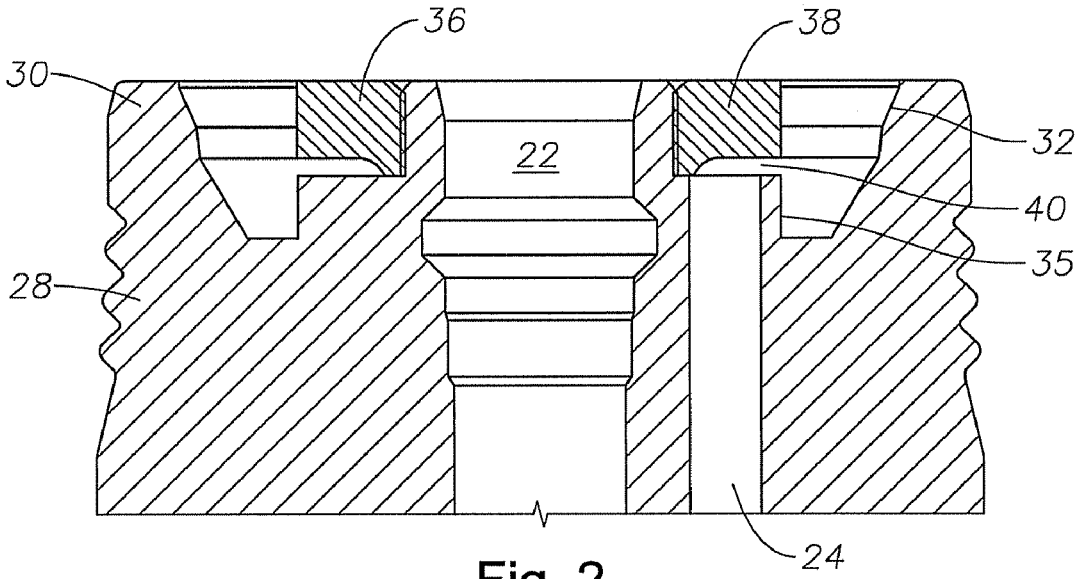
Fig. 2

NON-ORIENTING TREE CAP

BACKGROUND

1. Field of the Invention

This invention relates in general to wellhead tree assemblies, and in particular to a non-orienting tree cap used to seal a christmas tree.

2. Description of the Prior Art

In the prior art, one type of wellhead assembly located of a subsea well includes a wellhead housing located at the upper end of a conductor pipe. One or more casing hangers for supporting the casing land in the wellhead housing. After the well has been drilled to total depth, tubing is installed, the drilling riser is removed and a Christmas tree is lowered onto and connected to the wellhead housing. Thereafter, a tree cap is placed on top of the Christmas tree in order to seal against the flow of subterranean oil and gas.

One type of tree has a production passage and an offset annular passage that communicates with a tubing annulus surrounding the tubing. In prior art systems, the tree cap would include a production bore mandrel and an annular passage mandrel to insert into the production and annulus bores to seal against leakage of subterranean oil and gas. The dual mandrel design requires orientation in order to correctly insert the tree cap onto the tree. Remotely operated vehicles (ROV) have been used to orient the tree cap; however, the task is not easy. The annular and production passages and tree cap mandrels are sensitive to damage, thus, it's important to avoid damaging them during orientation.

SUMMARY OF THE INVENTION

The tree cap of the present invention includes a production mandrel for inserting into and sealing the production passage and an annular sealing member for sealing a communication gallery extending from the annulus passage. Unlike prior art tree caps which include both a production and annulus mandrel for sealing purposes, embodiments of the present assembly only include a production mandrel. Rotating the tree cap to orient it onto the tree is not required.

In one embodiment of the present invention, the tree assembly includes a production and annulus bore located at the upper end of the tree assembly, an annular cavity located at the upper end of the tree assembly, a communication gallery extending between the annulus bore and the annular cavity, and a tree cap for fitting on top of the tree assembly. The tree cap includes a production bore mandrel which extends from an upper portion of the tree cap down into the production bore, thereby forming a seal inside of the production bore. The tree cap also includes an annular sealing member extending from an upper portion of the tree cap down into the annular cavity such that the annular sealing member forms a seal between the communication gallery and the annular cavity.

In the preferred embodiment of the present invention, the production bore mandrel includes a drive head member, cam member, and locking element which engages the cam member such that as the drive head member moves downward, the cam member is pushed into an outward direction, thereby forcing the locking element outward into a locking position with the production bore.

BRIEF DESCRIPTION OF THE DRAWINGS

FIG. 1 is a partial sectional view of a wellhead housing and Christmas tree according to an embodiment of the present invention;

FIG. 2 is an enlarged, partial sectional view of the tree cap of FIG. 1;

DETAILED DESCRIPTION OF THE INVENTION

Figure 3:
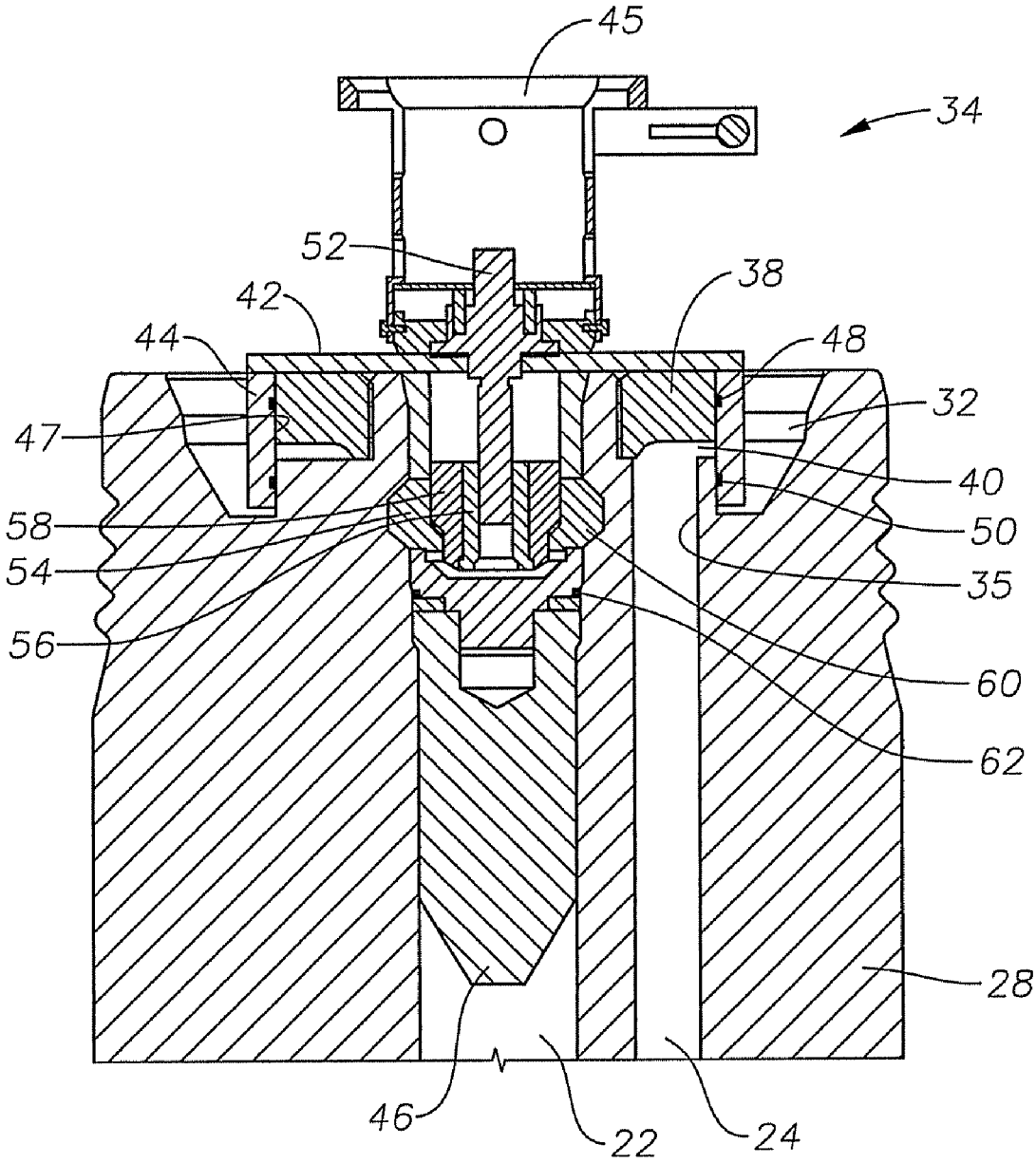
FIG. 3 is an enlarged, partial sectional view of the tree cap of FIG. 1 shown atop a wellhead tree assembly according to an embodiment of the present invention.

The present invention now will be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

FIG. 1 illustrates an exemplary embodiment of a subsea wellhead assembly 10 used in the exploration and retrieval of oil and gas in subterranean formations. As is known in the art, wellhead assembly 10 includes an outer wellhead housing 12 inserted into an earth formation. An inner wellhead housing 14 lands in outer wellhead housing 12. A string of casing 16 is connected to a casing hanger 18 and extends inside inner wellhead housing 14. Some wellheads have additional strings of casing. A tubing hangar 20 lands in wellhead housing 18 and supports a string of tubing 21. Tubing 21 extends downhole inside casing 16 in order to provide a production passage 22 which extends downhole from the surface in order to retrieve oil and gas. A tubing annulus 23 surrounds tubing 21. Extending around the upper end of inner wellhead housing 14 is a connector 26 used to connect a tree 28 to wellhead housing 14. Tree 28 has a production passage 22 that extends through it and communicates with tubing 21. Tree 28 also has a plurality of valves 25 for controlling flow though production. Tree 28 also has an annular bore 24 offset and parallel to production bore 22 for communication with tubing annulus 23.

Referring to FIG. 2, an exemplary embodiment of the present invention will now be further described. An annular cavity 32 is formed at the upper end 30 of tree 28, wherein a tree cap 34 (FIG. 3) can be inserted. Annular cavity 32 has a lower end below the upper end of tubing annulus bore 24, defining an annular outward facing cylindrical surface 35. Annular cavity 32 encircles and is radially spaced outward from production bore 22. A portion of annular cavity 32 intersects and communicates with tubing annulus bore 24. Extending around the upper end of tree 28 is a ring 38 which interfaces with threads 36 extending around the inside surface of annular cavity 32. Ring 38 has a recess on its lower side defining a communication gallery 40 located below ring 38. Communication gallery 40 extends from annulus passage 24 to annular cavity 32. Ring 38 has a cylindrical exterior surface located with annular cavity 32. Ring 38 could be integrally formed with tree 28 or otherwise attached.

Figure 4:
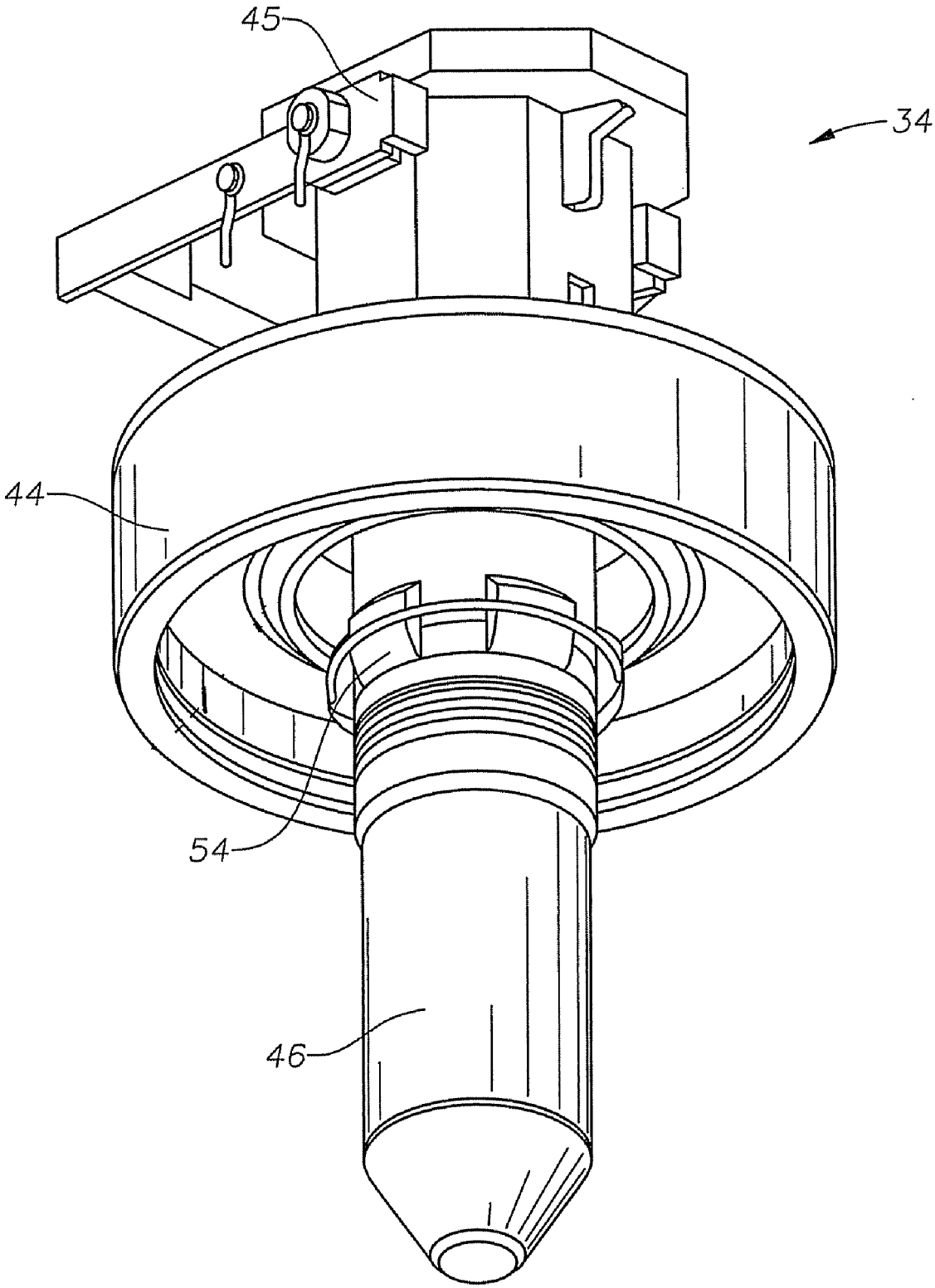
FIG. 4 is a perspective view of the tree cap of FIG. 3.

Referring to FIGS. 3 and 4, an exemplary embodiment of the present invention will be further described with reference to the sectional view of tree cap 34. Tree cap 34 has an upper flat surface 42 having a cylindrical flange 44 connected thereto and extending downwardly into annular cavity 32. The inner diameter 47 of flange 44 slides close by over the outer diameter of ring 38. Extending downwardly from upper surface 42 into production passage 22 is a mandrel 46 which is used to form a seal for production passage 22. Also attached to the upper surface 42 is a hinged handle 45 which is used to transport and maneuver tree cap 34 into position.

Flange 44 has an interior surface 47 which abuts ring 38 and is used to form a seal for annulus passage 24. At the upper end of interior surface 47 is a seal 48 which forms seals between ring 38 and interior surface 47. A seal 50 is at the lower portion of interior surface 47 which forms another seal between interior surface 46 and tree 28. Communication gallery 40 is closed by flange 44 and seals 48,50.

Further referring to FIGS. 3 and 4, production mandrel 46 forms a seal or closure for production passage 22. A drive head 52 extends downward within production mandrel 46 to actuate a locking element 54 which extends around the outside diameter of production mandrel 46. Locking mechanism 54 can be any number of locking devices such as, for example, dogs or split-ring designs. A threaded bushing 56 is located adjacent drive head 52, which can be rotated, thereby forcing threaded bushing 56 up or down. Grooves 60 extend around production passage 22 to receive locking element 54 when in a locking position. As bushing 56 moves downwardly, a cam member 58 is forced outwardly which, in turns, forces locking element 54 into grooves 60 and locks tree cap 34 into place. An annular seal 62 is located below locking element 54 and forms the seal against production bore 22.

This invention has significant advantages. Unlike prior art tree caps which include a dual production and annular mandrel, the tree cap of the present invention only includes a production passage mandrel. Orientation is not required. The tree cap is light weight, having only a single sealing mandrel. As such, the present invention decreases the difficulty in installing the tree cap onto the tree, thereby reduces operational time and costs. In addition, the design of the present invention protects against damage to the production and annular passages during installation.

While this invention has been shown in only one of its forms, it should be apparent to those skilled in the art that it is not so limited but is susceptible to various changes without departing from the spirit and scope of the invention. In the drawings and specification, there have been disclosed illustrative embodiments of the invention and, although specific terms are employed, they are used in a generic and descriptive sense only and not for the purpose of limitation, the scope of the invention being set forth in the following claims.

We claim:

1. A subsea well production tree comprising:

a tree block having a production bore and an annulus bore, each of which has an upper end at an upper end of the tree block, the upper ends of the production bore and the annulus bore being isolated from each other by part of the tree block;

an annular cavity at the upper end of the tree block surrounding the upper ends of the production and annulus bores, the annular cavity having an inner wall spaced radially outward from and isolated from the production bore by part of the tree block;

a communication port extending through part of the tree block between the upper end of the annulus bore and the annular cavity and isolated from the production bore;

a tree cap for fitting on top of the tree assembly, the tree cap comprising:

a production bore mandrel extending from an upper portion of the tree cap down into the production bore such that a seal is formed inside the production bore;

an annular sealing member extending from an upper portion of the tree cap down into the annular cavity such that the annular sealing member forms a seal between the communication port and the annular cavity; wherein the communication port comprises a communication gallery that extends through the inner wall of the annular cavity;

the tree block further comprises a ring that is located above the upper end of the annulus bore and encircles the upper end of the production bore; and the inner wall of the annular cavity terminates below the ring, with the space between the ring and the inner wall of the annular cavity defining the communication gallery.

2. The production tree of claim 1 further comprising:

an upper seal located between an outer wall of the ring and the inner surface of the annular sealing member; and a lower seal located below the communication gallery between the inner wall of the annular cavity and the inner surface of the annular sealing member.

3. A subsea well production tree comprising:

tree block having a production bore and an annul us bore, each of which has an upper end at an upper end of the tree block, the upper ends of the production bore and the annulus bore being isolated from each other by part of the tree block;

an annular cavity at the upper end of the tree block surrounding the upper ends of the production and annulus bores, the annular cavity having an inner wall spaced radially outward from and isolated from the production bore by part of the tree block;

a communication port extending through part of the tree block between the upper end of the annulus bore and the annular cavity and isolated from the production bore;

a tree cap for fitting on top of the tree assembly, the tree cap comprising:

a production bore mandrel extending from an upper portion of the tree cap down into the production bore such that a seal is formed inside the production bore;

an annular sealing member extending from an upper portion of the tree cap down into the annular cavity such that the annular sealing member forms a seal between the communication port and the annular cavity; wherein the production bore mandrel comprises:

a drive head member located within the production bore mandrel;

a cam member which engages the drive head member; and a locking element which engages the cam member such that as the drive head member moves downward, the cam member is pushed in an outward direction, thereby forcing the locking element outward into a locking position with an inner diameter of the production bore.

4. A method of sealing a well production tree having a production bore and annulus bore, the method comprising the steps of:

(a) providing an annular cavity at the upper end of the well production tree surrounding upper ends of the production and annulus bores and isolated from the production bore by part of the tree;

(b) providing a communication port extending through part of the tree between the annulus bore and the annular cavity and isolated from the production bore by part of the tree;

(c) providing a tree cap with a production bore mandrel and an annular sealing member;

(d) landing the tree cap on the tree and inserting the mandrel into the production bore such that a seal is formed inside the production bore; and (e) inserting the annular scaling member into the annular cavity such that the annular sealing member forms a seal between the communication port and the annular cavity; wherein in step (c) the production bore mandrel comprises:

a drive head member located within the production bore mandrel;

a cam member which engages the drive head member; and a locking element which engages the cam member such that as the drive head member moves downward, the earn member is pushed in an outward direction, thereby forcing the locking element outward into a locking position with an inner diameter of the production bore.

5. The method of claim 4 further comprising the steps of:

surrounding an upper end of the production bore with a ring such that a portion of the ring is located above the upper end of the annulus bore;

providing an upper seal located between an outer wall of the ring and the inner surface of the annular sealing member; and providing a lower seal located between the inner wall of the annular cavity and the inner surface of the annular sealing member.

6. A subsea well production tree comprising:

a tree block having a production bore and an annulus bore, each of which has an upper end at an upper end of the tree block;

an annular cavity at the upper end of the tree block surrounding the upper end of the production and annulus bores;

a communication gallery extending between the upper end of the annulus bore and the annular cavity;

a tree cap for fitting on top of the tree assembly, the tree cap comprising:

a production bore mandrel extending from an upper portion of the tree cap down into the production bore such that a seal is formed inside the production bore;

a cylindrical flange member extending from an upper portion of the tree cap down into the gap such that the annular sealing member forms a seal between the communication gallery and the annular cavity; and a plurality of annular seals located on an inner surface of the cylindrical flange in order to form a seal for the communication gallery.

7. The production tree of claim 6 further comprising an annular ring located above the communication gallery.

8. The production tree of claim 7 wherein the plurality of annular seals comprise:

an upper seal located between an outer wall of the annular ring and the inner surface of the cylindrical flange; and a lower seal located between an inner surface of the annular cavity and the inner surface of the cylindrical flange.

9. The production tree of claim 6, wherein the communication gallery extends through an inner wall of the annular cavity.

10. The production tree of claim 6, wherein the production bore mandrel comprises:

a drive head member located within the production bore mandrel;

a cam member which engages the drive head member; and a locking element which engages the cam member such that as the drive head member moves downward, the cam member is pushed in an outward direction, thereby forcing the locking element outward into a locking position with an inner diameter of the production bore.

* * * * *